United States Patent [19]

Rock et al.

[11] Patent Number: 4,756,289

[45] Date of Patent: Jul. 12, 1988

[54] SELF-CONTAINED FUEL PRESSURE REGULATOR

[75] Inventors: Jeffrey A. Rock, Rochester; Carl H. Sherwood, Brockport, both of N.Y.

[73] Assignee: General Motors Corporation, Detroit, Mich.

[21] Appl. No.: 828,643

[22] Filed: Feb. 12, 1986

[51] Int. Cl.[4] ..... F02M 34/00

[52] U.S. Cl. ..... 123/463; 123/468; 123/447; 123/467

[58] Field of Search ..... 123/468, 463, 447, 456, 123/469–472, 467, 446, 457

[56] References Cited

U.S. PATENT DOCUMENTS

| | | | |
|---|---|---|---|
| 2,948,273 | 8/1960 | Suttle | 123/463 |
| 3,511,270 | 5/1970 | Fehrenbach | 123/463 |
| 4,235,205 | 11/1980 | Fukui | 123/463 |
| 4,300,510 | 11/1981 | Ishida | 123/463 |
| 4,570,601 | 2/1986 | Ito | 123/468 |
| 4,633,901 | 1/1987 | Brandt | 123/463 |

OTHER PUBLICATIONS

"Buick Electra-Park Avenue Chassis Service Manual", 1985, Buick Motor Division, General Motors Corporation, Flint, Mich.

Asayama, Japan Pat. No. 57-195862, Derwant Abstract, Dec. 1, 1982.

*Primary Examiner*—Carl Stuart Miller

*Attorney, Agent, or Firm*—C. K. Veenstra

[57] ABSTRACT

A fuel pressure regulator base has a fuel chamber adapted for plug-connection directly to the fuel rail to receive fuel from the rail, a flexible diaphragm closes the chamber, a cover forms a pressure chamber with the diaphragm, and the pressure regulator base further has a pressure passage adapted for plug-connection directly to the inlet manifold and extending to the pressure chamber to transfer the manifold pressure to the pressure chamber. The diaphragm thereby senses the difference between the fuel pressure and the manifold pressure and operates a valve to discharge excess fuel from the fuel chamber and the fuel rail and thus maintain the fuel in the rail at the desired pressure.

1 Claim, 6 Drawing Sheets

SELF-CONTAINED FUEL PRESSURE REGULATOR

TECHNICAL FIELD

This invention relates to a fuel pressure regulator for an internal combustion engine fuel injection system.

BACKGROUND

A fuel injection system for an automotive engine, in which electromagnetic fuel injectors deliver fuel from a fuel rail to the engine inlet manifold adjacent the engine combustion chamber inlet ports, ordinarily includes a fuel pressure regulator to control the pressure of the fuel in the rail. In such a system, the pressure in the fuel rail is usually controlled to maintain a constant pressure difference across the injector—from the pressure in the fuel rail to the pressure in the manifold. The fuel pressure regulator accordingly is connected to the inlet manifold to sense the manifold pressure, and to the fuel rail to sense the fuel pressure in the rail and to discharge excess fuel from the rail so the fuel pressure in the rail varies with the manifold pressure and is maintained at the desired difference above the manifold pressure.

SUMMARY OF THE INVENTION

This invention provides a self-contained fuel pressure regulator adapted for plug-connection directly to an engine inlet manifold and fuel rail assembly. This fuel pressure regulator accordingly eliminates the need for extra connectors and fittings to connect the fuel pressure regulator to the manifold and fuel rail and thereby simplifies installation of the fuel pressure regulator and reduces the clutter and congestion in the engine compartment.

In a fuel pressure regulator provided by this invention, the pressure regulator base has a fuel chamber adapted for plug-connection directly to the fuel rail to receive fuel from the rail, a flexible diaphragm closes the chamber, a cover forms a pressure chamber with the diaphragm, and the pressure regulator base further has a pressure passage adapted for plug-connection directly to the inlet manifold and extending to the pressure chamber to transfer the manifold pressure to the pressure chamber. The diaphragm thereby senses the difference between the fuel pressure and the manifold pressure and operates a valve to discharge excess fuel from the fuel chamber and the fuel rail and thus maintain the fuel in the rail at the desired pressure.

The details as well as other features and advantages of two embodiments of this invention are set forth in the remainder of the specification and are shown in the accompanying drawings.

THE PREFERRED EMBODIMENTS

Figure 1:
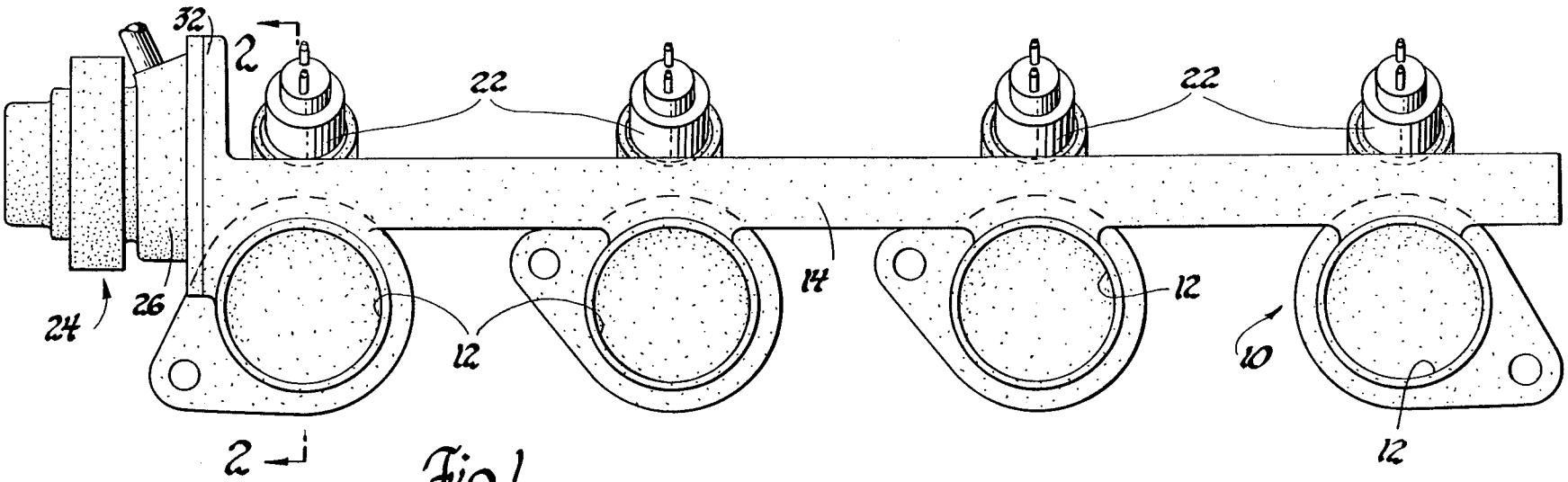
FIG. 1 is a view of a first embodiment of a self-contained fuel pressure regulator employing this invention, showing the regulator plug-connected directly to an engine manifold and fuel rail assembly.
Figure 2:
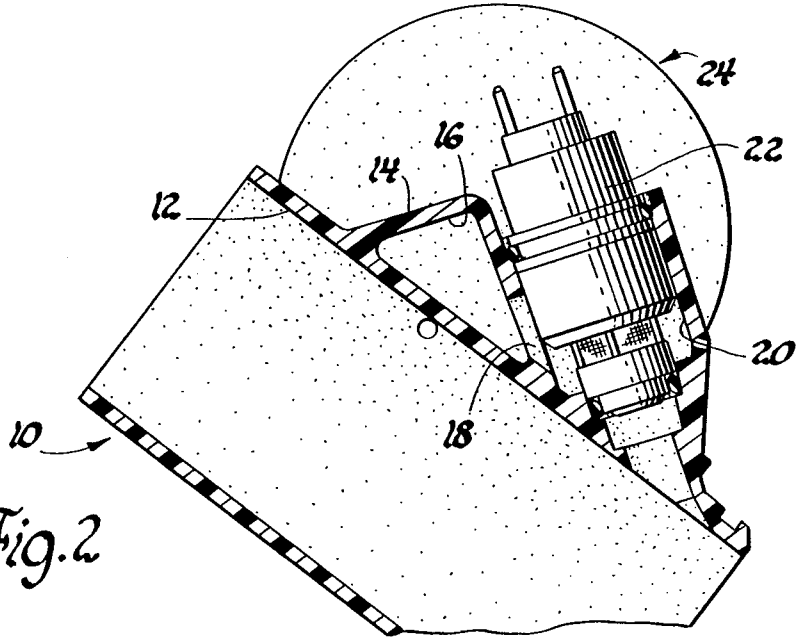
FIG. 2 is an enlarged sectional view of the FIG. 1 manifold and fuel rail assembly, taken along line 2—2 of FIG. 1, showing the association of the fuel rail and one of the injectors and further showing a manifold pressure fitting opening from the manifold.
Figure 3:
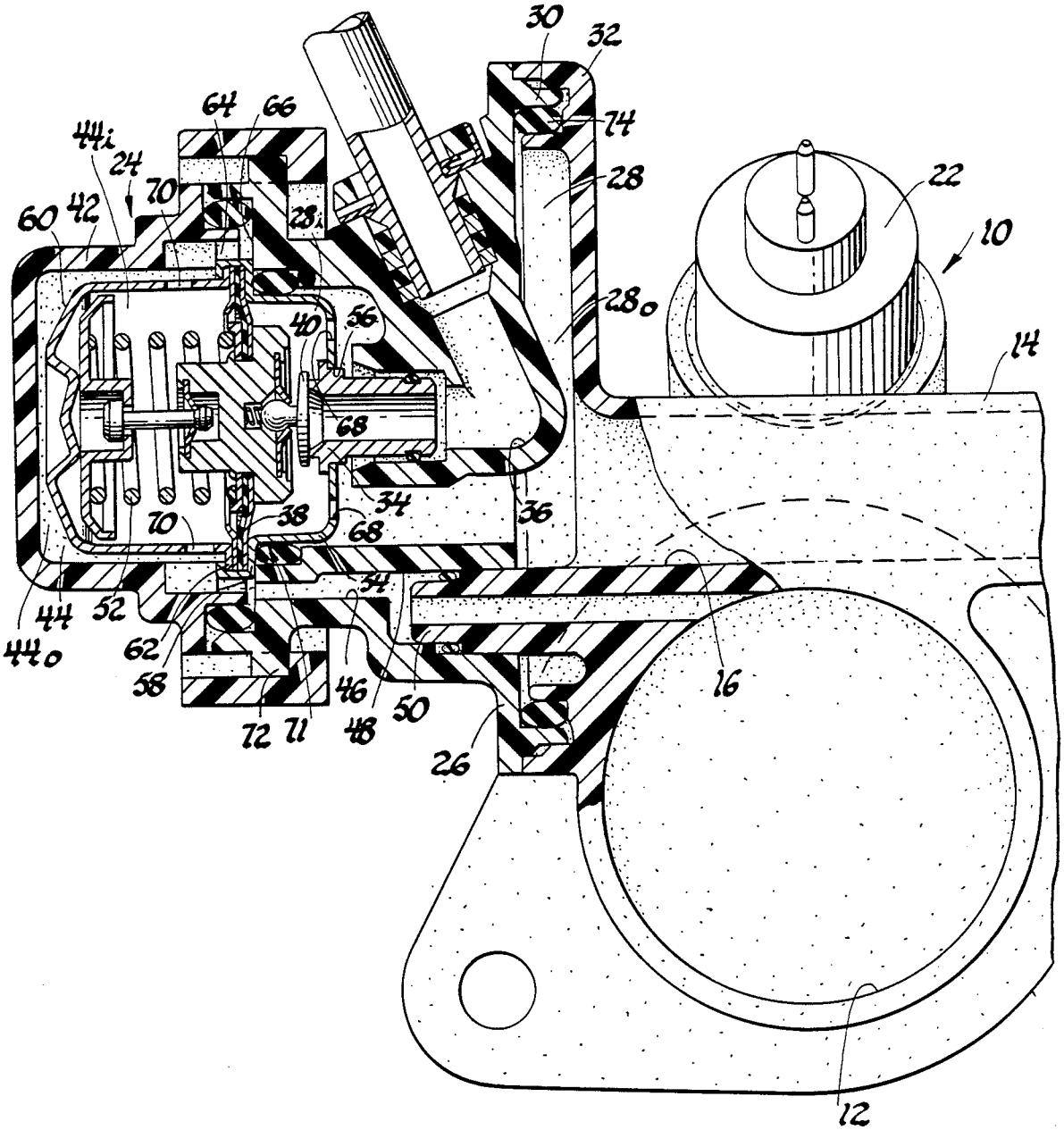
FIG. 3 is an enlarged view of the FIG. 1 fuel pressure regulator and the adjacent portion of the manifold and fuel rail assembly, with parts broken away to show the details of construction of the pressure regulator.
Figure 4:
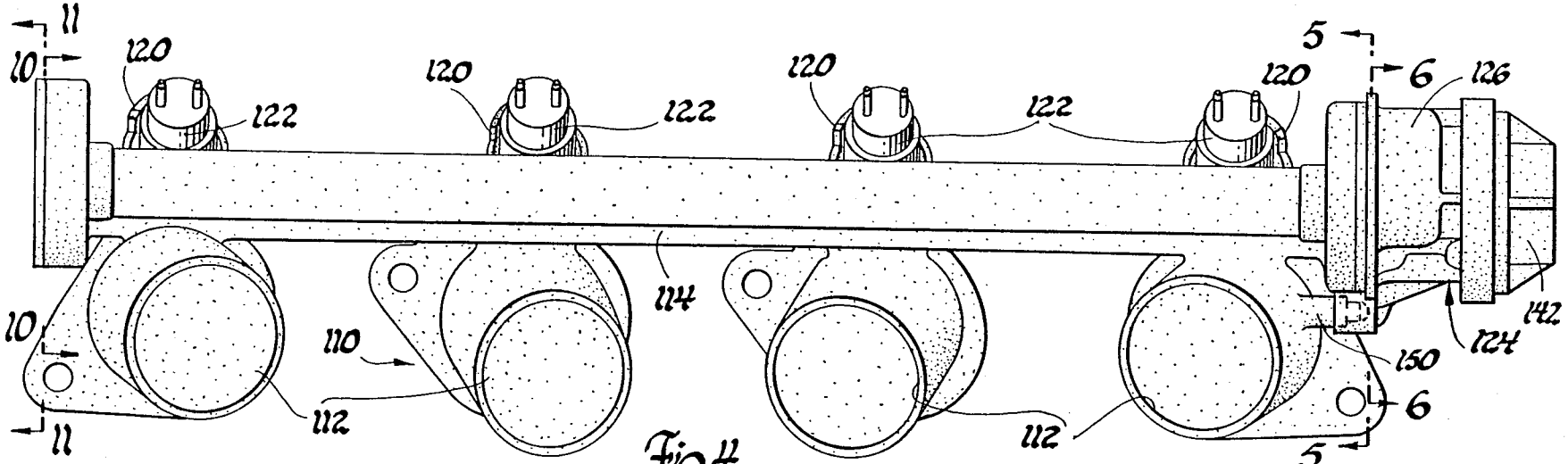
FIG. 4 is a view of a second embodiment of a self-contained fuel pressure regulator employing this invention, showing the regulator plug-connected directly to an engine manifold and fuel rail assembly.
Figure 6:
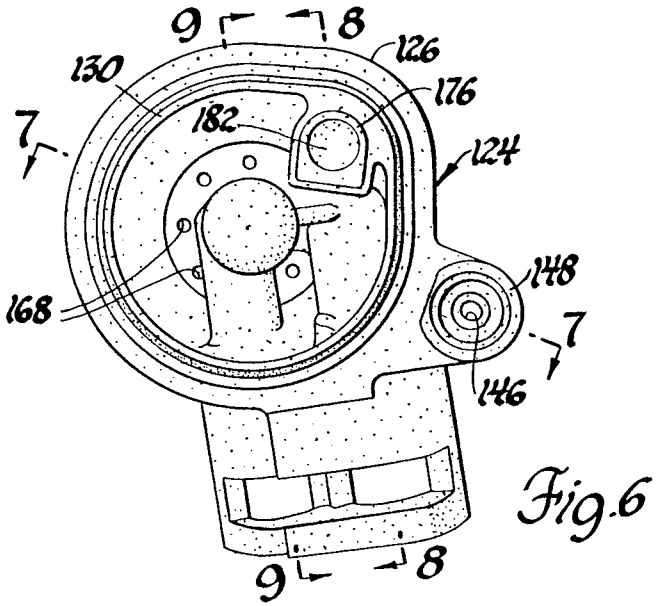
FIG. 6 is an enlarged view of the base of the FIG. 4 fuel pressure regulator, indicated by the line 6—6 of FIG. 3.
Figure 5:
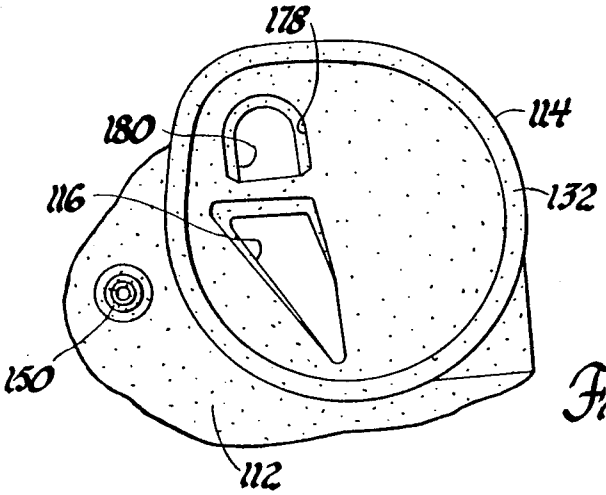
FIG. 5 is an enlarged view of the right-hand end of the FIG. 4 fuel rail, indicated by the line 5—5 of FIG. 4, showing the the fuel rail inlet bore and supply passage and further showing a manifold pressure fitting opening from the manifold.
Figure 7:
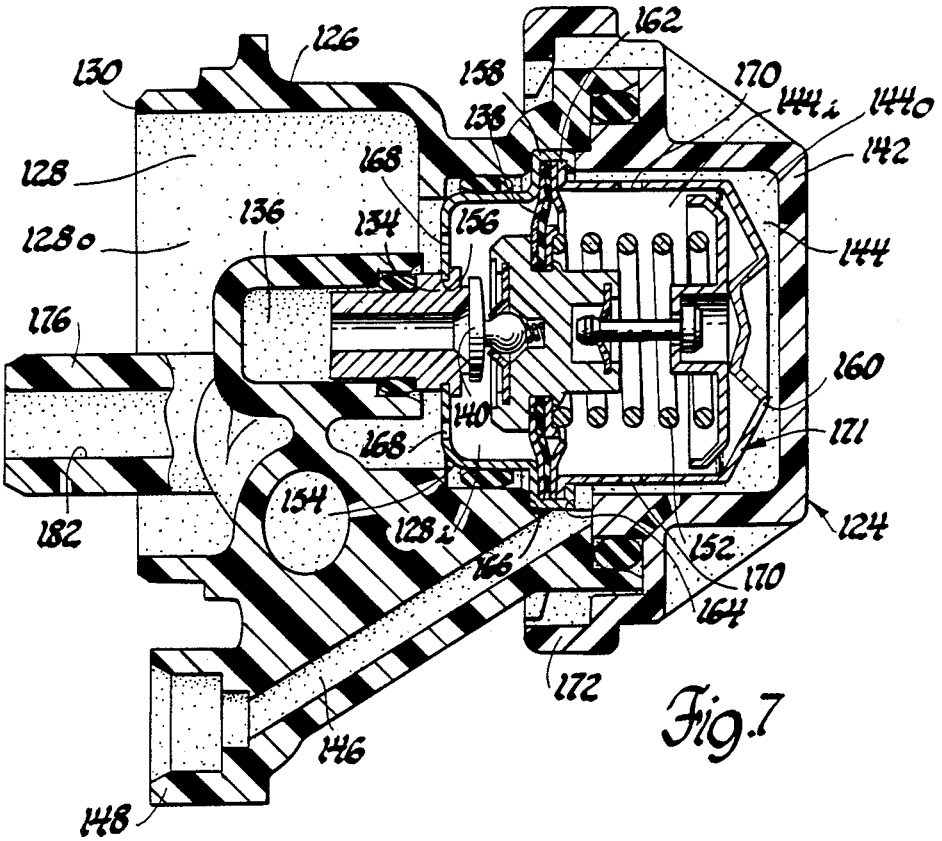
FIG. 7 is an enlarged sectional view of the FIG. 4 fuel pressure regulator removed from the manifold and fuel rail assembly, taken along line 7—7 of FIG. 6, showing the details of construction of the pressure regulator.
Figure 8:
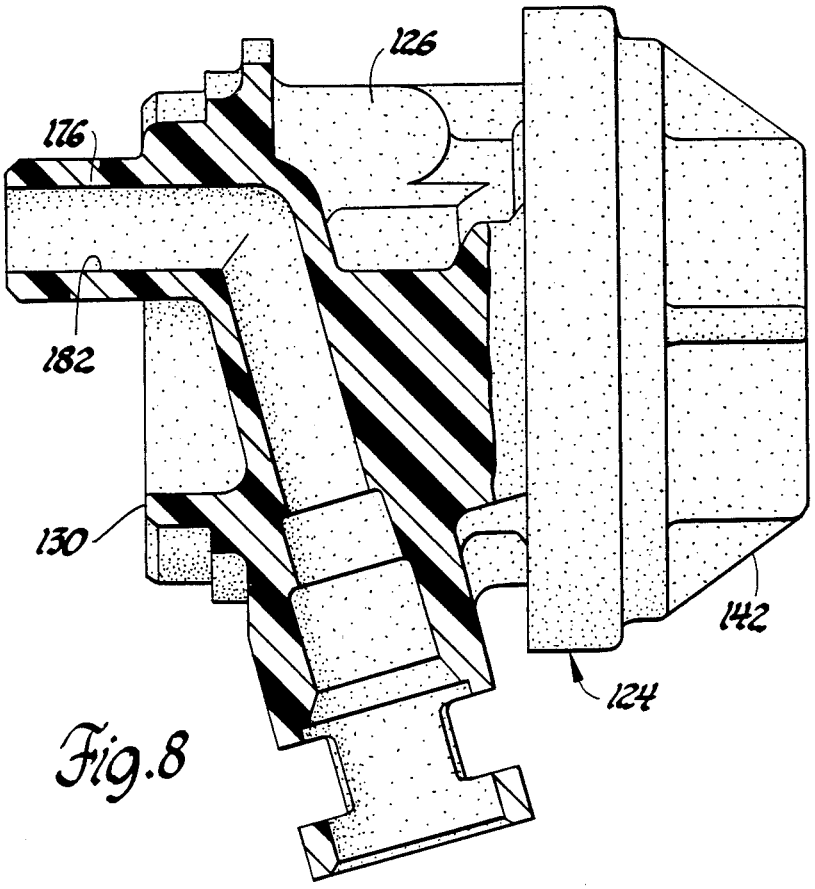
FIG. 8 is an enlarged view of the FIG. 4 fuel pressure regulator removed from the manifold and fuel rail assembly, with parts broken away as indicated by the line 8—8 of FIG. 6 to show a fuel inlet passage leading to the fuel rail inlet bore.
Figure 9:
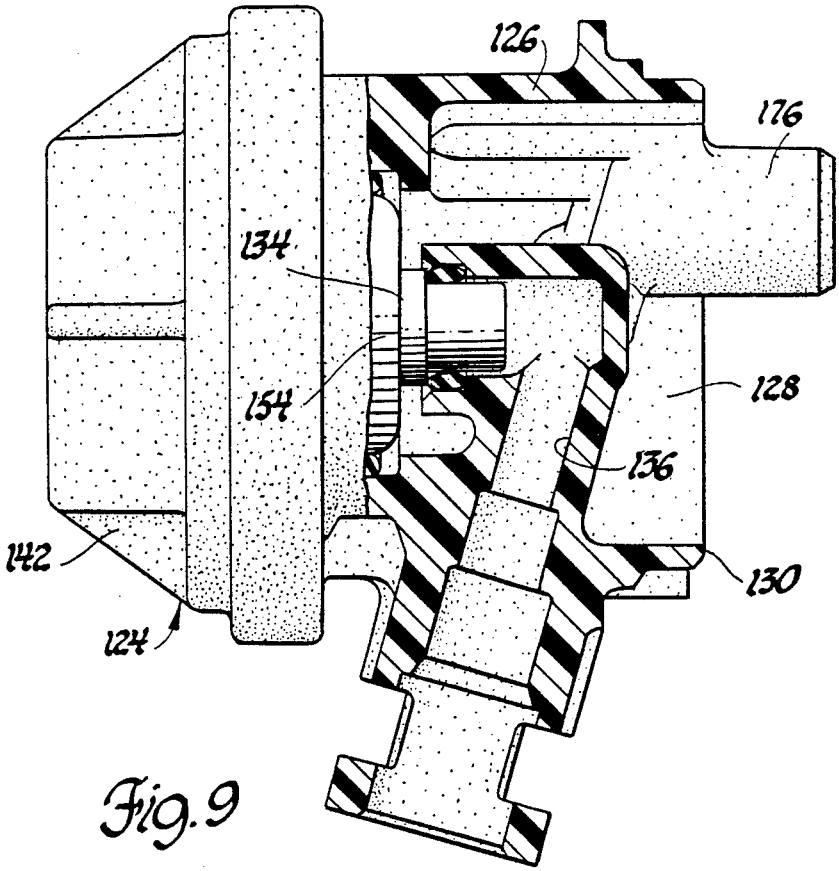
FIG. 9 is an enlarged view of the FIG. 4 fuel pressure regulator removed from the manifold and fuel rail assembly, with parts broken away as indicated by the line 9—9 of FIG. 6 to show a fuel discharge passage.
Figure 10:
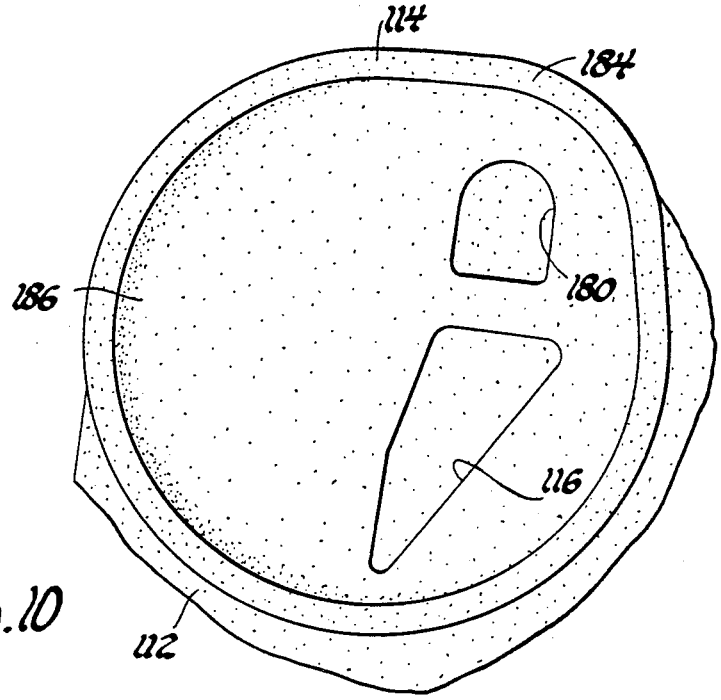
FIG. 10 is an enlarged view of the left-hand end of the FIG. 4 fuel rail, taken as indicated by the line 10—10 of FIG. 4, showing the fuel rail inlet bore and supply passage.

Referring first to the embodiment of FIGS. 1-3, an inlet manifold and fuel rail assembly 10 is molded from plastic as a single piece. Assembly 10 includes four inlet runners 12 through which air flows to the inlet ports for the engine combustion chambers (not shown). Assembly 10 further includes a fuel rail 14 having a fuel supply passage 16 which receives fuel at the right-hand end (as viewed in FIG. 1) and has openings 18 which supply fuel to injector sockets 20 associated with each runner 12. Each socket 20 has an electromagnetic injector 22 that delivers fuel from the fuel rail supply passage 16 to the associated inlet manifold runner 12.

A self-contained fuel pressure regulator assembly 24 maintains the pressure of the fuel in supply passage 16 at a constant difference above the inlet pressure in the manifold runners 12. Pressure regulator assembly 24 has a base 26 that forms a portion of a fuel chamber 28 and is provided with a rim 30 that mates with an adapter rim 32 provided at the end of fuel rail 14. Pressure regulator base 26 is thereby adapted for plug-connection directly to adapter rim 32 to receive fuel from the fuel rail supply passage 16.

Pressure regulator base 26 also has a valve seat 34 through which fuel flows from chamber 28 to a fuel discharge passage 36. A flexible diaphragm 38 closes chamber 28 and positions a valve member 40 to control fuel flow through valve seat 34. A cover 42 forms a pressure chamber 44 with diaphragm 38, and base 26 has a pressure passage 46 extending to chamber 44 to transfer the pressure in inlet manifold runners 12 to chamber 44. Passage 46 is provided with a rim 48 which mates with a fitting 50 opening from one of the inlet manifold runners 12. Pressure regulator base 26 is thereby adapted for plug-connection directly to fitting 50 to sense the inlet manifold pressure.

A spring 52 has a bias supplementing the manifold pressure in pressure chamber 44 acting on diaphragm 38 and opposing the fuel pressure in fuel chamber 28 acting on diaphragm 38. Diaphragm 38 flexes in response to variations in fuel pressure in fuel chamber 28 and manifold pressure in pressure chamber 44 and positions valve member 40 to maintain the pressure in fuel chamber 28 and thus in the fuel rail supply passage 16 balanced with the bias of spring 52 and the pressure in pressure chamber 44 and thus in the inlet manifold runners 12.

A base housing 54 has a central opening 56 secured about valve seat 34 and a rim 58 disposed between diaphragm 38 and base 26. Base housing 54 divides fuel chamber 28 into an inner fuel chamber 28*i* between base housing 54 and diaphragm 38 and an outer fuel chamber 28*o* between base housing 54 and base 26. A cover housing 60 has a rim 62 disposed between diaphragm 38 and cover 42. Cover housing 60 divides pressure chamber 44 into an inner pressure chamber 44*i* between cover housing 60 and diaphragm 38 and an outer pressure chamber 44*o* between cover housing 60 and cover 42. Housings 54 and 60 are clamped together about rims 58 and 62 with diaphragm 38 retained therebetween, and rims 58 and 62 are clamped between a shoulder 64 inside cover 42 and a ledge 66 formed on base 26. Base housing 54 has apertures 68 for fuel flow from outer fuel chamber 28*o* to inner fuel chamber 28*i*, and cover housing 60 has apertures 70 for pressure transfer between outer pressure chamber 44*o* and inner pressure chamber 44*i*. Base housing 54 and valve seat 34, cover housing 60, spring 52, and diaphragm 38 and valve member 40 form a subassembly 71 which may be pre-assembled and calibrated prior to assembly into pressure regulator assembly 24.

Cover 42 is secured to base 26 about their perimeters 72 by a bayonet-type connection the details of which are not important here. An 0-ring 74 seals against escape of fuel between rims 30 and 32, and the rim 30 of base 26 may be welded to adapter rim 32 to provide a redundant seal.

Referring next to the embodiment of FIGS. 4–13, an inlet manifold and fuel rail assembly 110 is molded from plastic as a single piece. Assembly 110 includes four inlet runners 112 through which air flows to the inlet ports for the engine combustion chambers (not shown). Assembly 110 further includes a fuel rail 114 having a fuel supply passage 116. Supply passage 116 has openings that supply fuel to injector sockets 120 associated with runners 112. Each socket 120 has an electromagnetic injector 122 that delivers fuel from the fuel rail supply passage 116 to the associated inlet manifold runner 112.

A self-contained fuel pressure regulator assembly 124 maintains the pressure of the fuel in supply passage 116 at a constant difference above the inlet pressure in the manifold runners 112. Pressure regulator assembly 124 has a base 126 that forms a portion of a fuel chamber 128 and is provided with a rim 130 that mates with an adapter rim 132 (FIG. 5) provided at the end of fuel rail 114. Pressure regulator base 126 is thereby adapted for plug-connection directly to adapter rim 132 to receive fuel from the fuel rail supply passage 116.

Pressure regulator base 126 also has a valve seat 134 through which fuel flows from chamber 128 to a fuel discharge passage 136. A flexible diaphragm 138 closes chamber 128 and positions a valve member 140 to control fuel flow through valve seat 134. A cover 142 forms a pressure chamber 144 with diaphragm 138, and base 126 has a pressure passage 146 extending to chamber 144 to transfer the pressure in inlet manifold runners 112 to chamber 144. Passage 146 is provided with a rim 148 which mates with a fitting 150 opening from one of the inlet manifold runners 112. Pressure regulator base 126 is thereby adapted for plug-connection directly to fitting 150 to sense the inlet manifold pressure.

A spring 152 has a bias supplementing the manifold pressure in pressure chamber 144 acting on diaphragm 138 and opposing the fuel pressure in fuel chamber 128 acting on diaphragm 138. Diaphragm 138 flexes in response to variations in fuel pressure in fuel chamber 128 and manifold pressure in pressure chamber 144 and positions valve member 140 to maintain the pressure in fuel chamber 128 and thus in the fuel rail supply passage 116 balanced with the bias of spring 152 and the pressure in pressure chamber 144 and thus in the inlet manifold runners 112.

A base housing 154 has a central opening 156 secured about valve seat 134 and a rim 158 disposed between diaphragm 138 and base 126. Base housing 154 divides fuel chamber 128 into an inner fuel chamber 128*i* between base housing 154 and diaphragm 138 and an outer fuel chamber 128*o* between base housing 154 and base 126. A cover housing 160 has a rim 162 disposed between diaphragm 138 and cover 142. Cover housing 160 divides pressure chamber 144 into an inner pressure chamber 144*i* between cover housing 160 and diaphragm 138 and an outer pressure chamber 144*o* between cover housing 160 and cover 142. Housings 154 and 160 are clamped together about rims 158 and 162 with diaphragm 138 retained therebetween, and rims 158 and 162 are clamped between a projection 164 inside cover 142 and a ledge 166 formed on base 126. Base housing 154 has apertures 168 for fuel flow from outer fuel chamber 128*o* to inner fuel chamber 128*i*, and cover housing 160 has apertures 170 for pressure transfer between outer pressure chamber 144*o* and inner pressure chamber 144*i*. Base housing 154 and valve seat 134, cover housing 160, spring 152, and diaphragm 138 and valve member 140 form a subassembly 171 which may be pre-assembled and calibrated prior to assembly into pressure regulator assembly 124.

Cover 142 is secured to base 126 about their perimeters 172 by a bayonet-type connection the details of which are not important here. An 0-ring may be provided to seal against escape of fuel between rims 130 and 132, and the rim 130 of base 126 may be welded to adapter rim 132 to provide a redundant seal.

Pressure regulator base 126 has a projection 176 which mates with a recess 178 at the end of a fuel supply bore 180 in fuel rail 114. A fuel inlet passage 182 extends through pressure regulator base 126 and projection 176 to provide fuel to supply bore 180.

At its opposite end, fuel rail 114 has a rim 184 surrounding a recess 186 that connects fuel supply bore 180 to fuel supply passage 116. A plug 188 closes recess 186.

Figure 11:
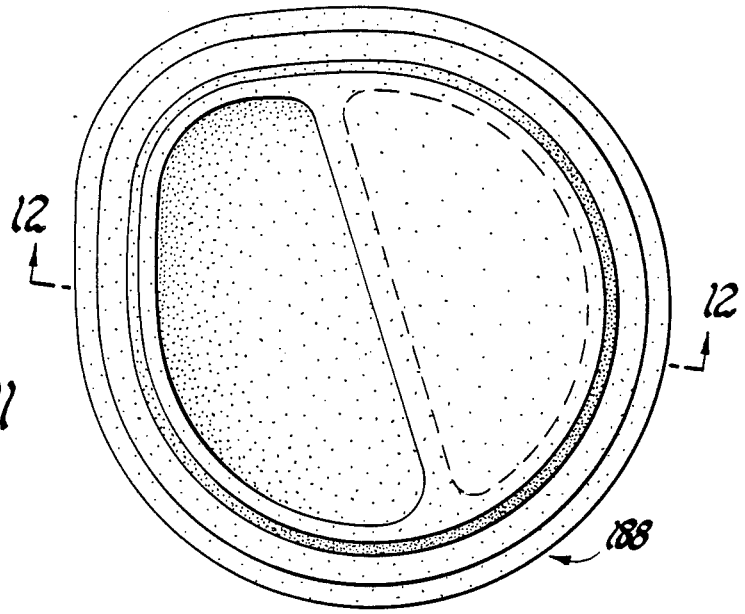
FIG. 11 is an enlarged view of the base of a plug at the left-hand end of the FIG. 4 fuel rail, taken as indicated by the line 11—11 of FIG. 4.
Figure 12:
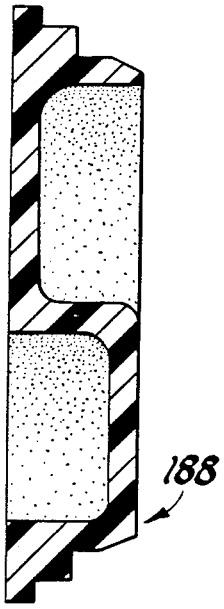
FIG. 12 is an enlarged sectional view of the plug, taken along line 12—12 of FIG. 11.
Figure 13:
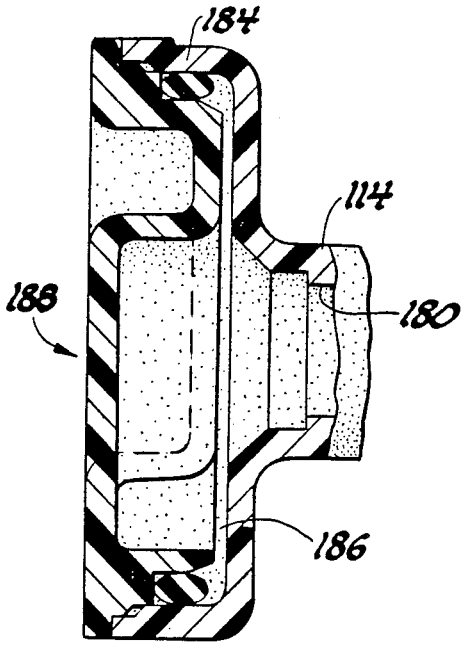
FIG. 13 is an enlarged view of the left-hand end of the FIG. 4 fuel rail, with parts broken away to show the plug directing fuel from the fuel rail inlet bore to the fuel rail supply passage.

Plug 188 is configured as shown in FIGS. 11–13 to direct fuel from inlet bore 180 to supply passage 116.

The embodiments of the invention in which an exclusive property or privilege is claimed are defined as follows:

1. A self-contained fuel pressure regulator assembly adapted for plug-connection directly to an engine manifold and fuel rail assembly, said manifold and fuel rail assembly having a fitting for transferring pressure from said manifold and an adapter for transferring fuel from said fuel rail, said pressure regulator assembly comprising a base having a fuel chamber adapted for plug-connection directly to said adapter to receive fuel from said fuel rail, said base also having a fuel discharge passage and a valve seat in said discharge passage through which fuel flows from said chamber to said discharge passage, a flexible diaphragm closing said chamber, a valve member positioned by said diaphragm to control fuel flow through said valve seat, a cover forming a pressure chamber with said diaphragm, said base further having a pressure passage adapted for plug-connection directly to said fitting, said pressure passage extending to said pressure chamber to transfer the pressure in said manifold to said pressure chamber, and a spring having a bias supplementing the manifold pressure in said pressure chamber acting on said diaphragm and opposing the fuel pressure in said fuel chamber acting on said diaphragm, whereby said diaphragm may flex in response to variations in fuel pressure in said fuel chamber and manifold pressure in said pressure chamber and position said valve member to maintain the pressure in said fuel chamber and thus in said fuel rail balanced with the bias of said spring and the pressure in said pressure chamber and thus in said manifold, said fuel pressure regulator assembly further comprising a base housing having a central opening secured about said valve seat and a rim disposed between said diaphragm and said base, said base housing dividing said fuel chamber into an inner fuel chamber between said base housing and said diaphragm and an outer fuel chamber between said base housing and said base, and a cover housing having a rim disposed between said diaphragm and said cover, said cover housing dividing said pressure chamber into an inner pressure chamber between said cover housing and said diaphragm and an outer pressure chamber between said cover housing and said cover, wherein said housings are clamped together about said rims with said diaphragm retained therebetween, wherein said rims are clamped between said cover and said base, wherein said base housing has apertures for fuel flow from said outer fuel chamber to said inner fuel chamber, and wherein said cover housing has apertures for pressure transfer between said outer pressure chamber and said inner pressure chamber, whereby said base housing and said valve seat, said cover housing, and said diaphragm and said valve member form a subassembly which may be pre-assembled and calibrated prior to assembly into said self-contained pressure regulator assembly.

* * * * *